United States Patent [19]

Huston

[11] 4,304,383

[45] Dec. 8, 1981

[54] BRACKET FOR HOLDING A TANK

[76] Inventor: Paul O. Huston, 31 Lenape Dr., Montville, N.J. 07045

[21] Appl. No.: 71,581

[22] Filed: Aug. 31, 1979

[51] Int. Cl.[3] ..... A47F 5/00

[52] U.S. Cl. ..... 248/313; 211/88

[58] Field of Search ..... 248/309, 310, 311.2, 248/311.3, 312, 312.1, 313, DIG. 9, 316 R, 237; 211/88; 169/51

[56] References Cited

U.S. PATENT DOCUMENTS

| | | | |
|---|---|---|---|
| 546,081 | 9/1895 | Reyer | 248/313 |
| 2,277,738 | 3/1942 | Wilkinson | 248/311.2 X |
| 2,466,288 | 4/1949 | Waterman | 248/312.1 |
| 2,655,332 | 10/1953 | Carpenter et al. | 248/231 X |
| 2,771,110 | 11/1956 | Tuck | 52/98 |
| 2,879,018 | 3/1959 | Pence | 248/494 |
| 3,565,384 | 2/1971 | Lockwood | 248/312 |
| 4,033,534 | 7/1977 | Bergkuist | 248/DIG. 9 X |

FOREIGN PATENT DOCUMENTS

| | | | |
|---|---|---|---|
| 2657210 | 6/1978 | Fed. Rep. of Germany | 248/DIG. 9 |
| 118174 | 2/1947 | Sweden | 248/316 A |
| 309323 | 4/1929 | United Kingdom | 248/312 |

*Primary Examiner*—J. Franklin Foss
*Attorney, Agent, or Firm*—Darby & Darby

[57] ABSTRACT

A bracket unit for holding devices having tanks of various diameters such as fire extinguishers. In one embodiment, a pair of straps and a shim are detachably affixed to the body of the bracket by tabs so that the entire unit is initially of one piece construction. After being detached from the body, one end of each of the straps is engaged within one of a plurality of apertures defined at either side of the body. The bracket unit is adaptable to cylinders of various diameter by engaging the straps within appropriate apertures in the body. A clamp, having two prongs, at the upper portion of the body engages the neck portion of the fire extinguisher and stops at the ends of each prong limits possible rotation of the fire extinguisher so that the gauge is kept facing away from the bracket. A support at a lower portion of the body accommodates a portion of the cylinder. A shim may be removably attached to the support to accommodate smaller diameter cylinders.

7 Claims, 8 Drawing Figures

BRACKET FOR HOLDING A TANK

The present invention relates to a bracket for holding devices having tanks of various diameters, such as fire extinguishers, so that the device is readily removable from the bracket to provide quick access during emergency situations.

Various brackets for holding cylindrical shaped objects, including fire extinguishers, are taught in Lockwood, U.S. Pat. No. 3,565,384; R. F. Webber, U.S. Pat. No. 1,430,525; W. J. Davis, U.S. Pat. No. 3,224,644; L. F. Bassett, U.S. Pat. No. 3,292,890; and I. R. Krasnoff, U.S. Pat. No. 3,318,457.

In patents 3,318,457 and 3,224,644, a cylindrical object is inserted between a pair of clamping arms so that the clamping arms encompass the cylindrical object. In 3,318,457, the cylindrical object, an intravenous feeding bottle, is held by the clamping arms and by a bail which is attached by a metal band to support the cylindrical object. In 3,224,644, the cylindrical object, an aerosol container, is held by the clamping arms and by a horizontal bottom portion. In 3,292,890, the cylindrical object, a flashlight, is held by a horizontal bottom portion which supports the vertically arranged flashlight and by a semicircular loop which encompasses and loosely engages the barrel of the flashlight.

Each of these brackets of the prior art patents is used to mount a cylindrical object in a vertical and upright position. However, in certain applications it may be desirable to mount the fire extinguisher in horizontal, angled, or even in inverted vertical positions. Such mountings are either unstable or are not possible with the brackets taught in patents 3,224,644, 3,292,890 and 3,318,457. Patent 3,318,457 teaches hanging an intravenous bottle vertically by a bail which extends from the bottle. In 3,292,890 the object falls from the bracket if the bracket is inverted and in 3,292,890 and 3,224,644, the object can be jarred loose if the bracket is mounted horizontally. This is particularly so in vibration prone environments in which the brackets of the present invention may be used.

In the present invention, the neck portion of a tank is received within clamping means formed on an upper portion of a bracket body. One end of each strap of a pair of straps are detachably mounted within one of a plurality of apertures defined at either side of the bracket body. By engaging the pair of straps within appropriate apertures, the bracket can easily be adapted to hold tanks of various diameters. The opposite end of each of the pair of straps include means for removably engaging the tank within the straps. The pair of straps and the clamping means securely hold the tank so that the same may be mounted in vertical, horizontal, angled or even inverted vertical positions. The bracket body has a plurality of longitudinally extending ribs. At least one hole is formed in the bracket body between two adjacent ribs of the plurality of ribs. Screws, bolts, etc. are passed through the hole to mount the bracket body to a surface.

In 3,565,384 the fire extinguisher holding bracket is molded with the bracket in a one-piece construction and in both 1,430,525 and 3,565,384, the cylindrical object is encompassed by straps which detachably engage to define a single predetermined circumference. This is undesirable since the bracket cannot be adapted to cylindrical tanks of various diameter.

Accordingly, it is an object of the present invention to provide a bracket capable of accommodating tanks of various diameters.

It is a further object of the invention to provide a bracket which securely holds the tank and yet allows ready removal of the tank to provide quick access during emergency situations.

It is another object of the invention to provide a bracket of compact construction to facilitate storage and handling and to minimize packaging requirements.

It is still another object of the invention to provide a bracket which is economically manufactured.

These and other objects and advantages of the present invention will become more apparent upon reference to the following specification and annexed drawings in which.

Figure 1:
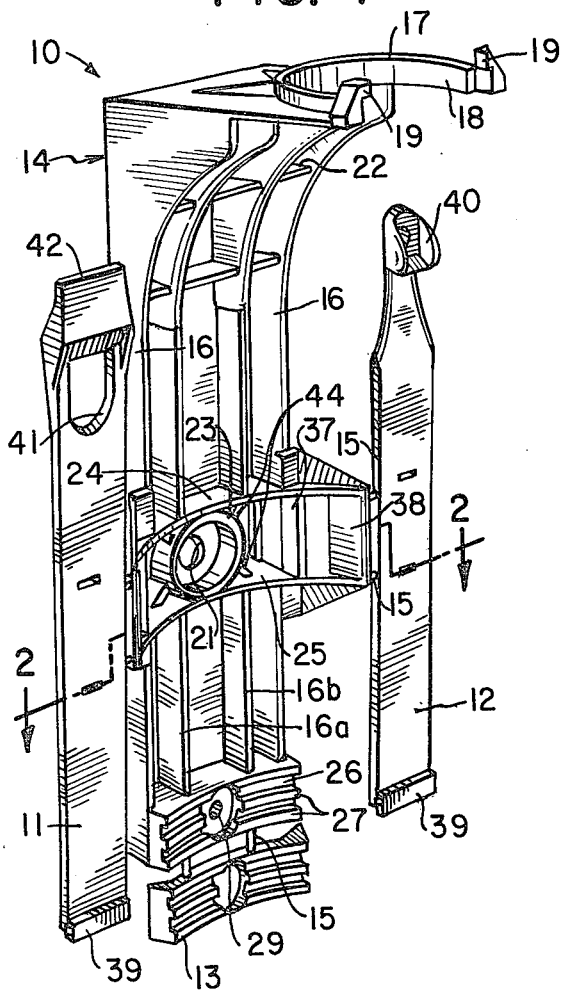
FIG. 1 is a perspective view of the bracket according to the present invention.
Figure 3:
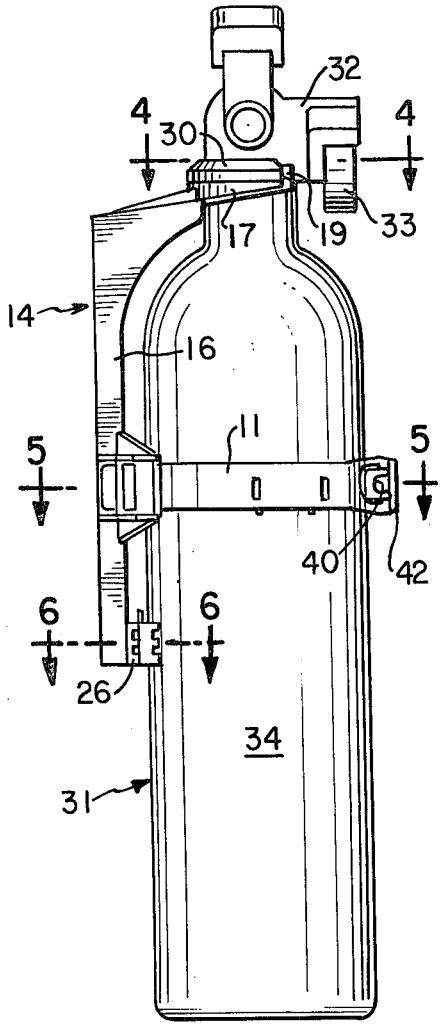
FIG. 3 is a side elevational view depicting the bracket with an attached fire extinguisher of the type having a cylindrical tank.
Figure 2:
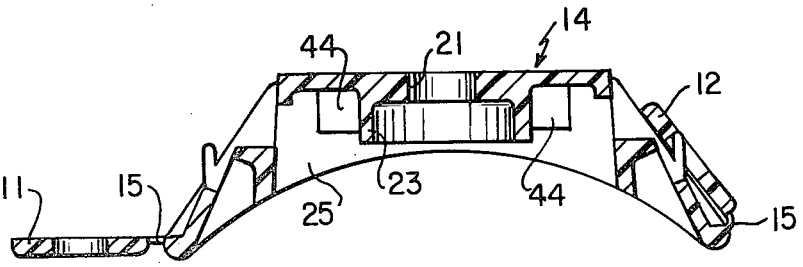
FIG. 2 is a cross-sectional plan view taken along the line 2—2 of FIG. 1.

Referring to FIGS. 1 and 3, the bracket unit 10 comprises a pair of straps 11, 12 which can be removably attached to body 14, as is more fully described below. In one embodiment, a shim 13 can be attached to the body 14 so that the bracket unit 10 can accommodate tanks of small diameter.

In a preferred embodiment, the entire bracket unit 10 is molded as one unit by conventional injection molding process. FIG. 1 depicts a bracket unit 10 as it would emerge from a mold. Straps 11 and 12 and shim 13 are attached to the body 14 by a plurality of tabs 15. Straps 11 and 12 are made to lie parallel with the longitudinal axis of the body 14 so that the bracket unit 10 provides a minimum silhouette which facilitates storing, handling and minimizes packaging requirements for the bracket. As described below, the straps 11, 12 and shim 13 can be detached from body 14 at tabs 15 and mounted to the body 14 to form the completed bracket unit 10.

The body 14 is formed with a plurality of ribs 16 which extend longitudinally along its front face. The ribs 16 increase the rigidity of the body 14 and provide an economical and light-weight construction requiring minimum use of material. At the upper portion of body 14, the ribs 16 curve outwardly and terminate in a top wall 46 having a semi-circular opening A. A semi-circular clamp 17 which supports the neck portion 30 of fire extinguisher 31 (see FIG. 3) is formed in the top wall around the opening. The clamp includes a vertical wall 17*a*.

Figure 4:
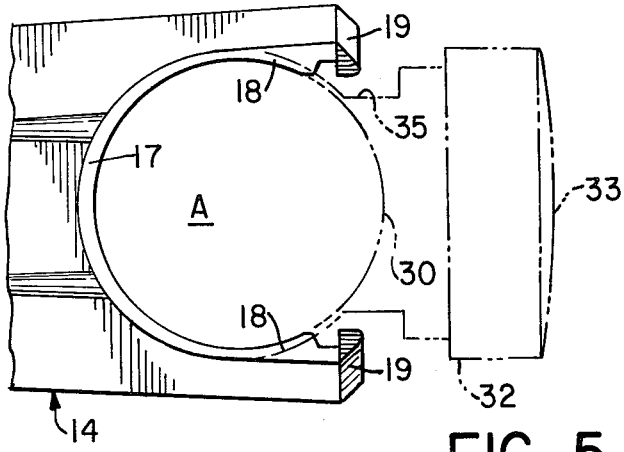
FIG. 4 is a cross-sectional plan view taken along the line 4—4 of FIG. 3.

As seen in FIG. 4, clamp 17 includes arms, or prongs 18, which define the semi-circular opening A. As seen in FIG. 3, the neck portion 30 of a fire extinguisher 31 is disposed within clamp 17 when the fire extinguisher is engaged on the body 14. The prongs 18 are formed to snap into and out of engagement with the neck portion 30 of extinguisher 31.

Figure 8:
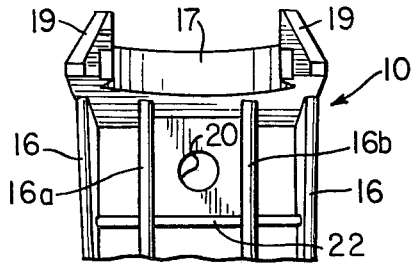
FIG. 8 is a partial front elevational view of a top portion of the bracket.

As seen in FIG. 1, body 14 includes a pair of longitudinally extending outer ribs 16 and inner ribs 16*a*, 16*b*. The body 14 is mounted to a surface at holes 20 and 21 formed in the body 14 between adjacent pairs of longitudinally extending ribs. As seen in FIG. 8, hole 20 is located between two inner ribs 16*a*, 16*b* and between top wall 46 which forms the semi-circular clamp 17 and a cross rib 22 which extends transverse to the longitudinal axis of the body 14. As seen in FIG. 1, the second hole 21 is located at a lower portion of body 14. A circular boss 23 encircles the hole 21 and is connected to cross ribs 24, 25 by a plurality of angled sprues 44 which radiate from the circular boss 23 to the cross ribs 24, 25. The body 14 may be secured to the desired surface, either horizontal, vertical or angled, by a variety of fastening means such as screws, nails, bolts, etc. It will be apparent, however, that a variety of alternative fastening means may be utilized to secure the bracket to the desired surface.

Support 26, at the lower portion of body 14, and shim 13 have, along their front faces, a plurality of curved ribs 27. Support 26 is curved to accommodate a portion of the cylindrical tank 34 of extinguisher 31.

Cylindrical tanks, such as fire extinguishers, come in a variety of diameters. Accordingly, in a preferred embodiment, shim 13 is detachably attached to the support 26 by several tabs 15. To accommodate smaller diameter cylindrical tanks, the shim 13 can be detached from the bottom of support 26 and mounted to the front face of support 26.

Figure 6:
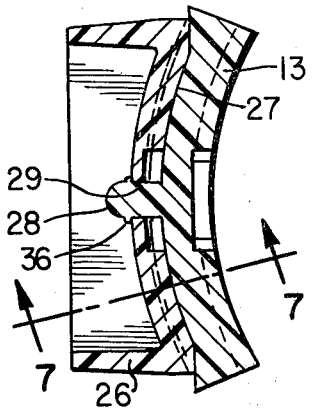
FIG. 6 is a cross-sectional plan view taken along the line 6—6 in FIG. 3.
Figure 7:
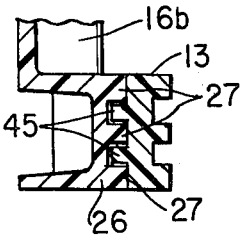
FIG. 7 is a cross-sectional elevational view taken along the line 7—7 of FIG 6.

Shim 13 may be mounted to the front face of support 26 in a variety of ways. As shown in FIG. 7, ribs 45 extend outwardly from the rear face of shim 13. Each rib 45 engages between adjacent pairs of curved ribs 27 which extend along the front face of support 26. A projection 28 (see FIG. 6) which protrudes from the rear face of shim 13 engages within a corresponding aperture 29 in support 26 and ridge 36, extending transversely from the projection 28, holds the shim 13 onto support 26. As seen in FIG. 3, the cylindrical portion of the fire extinguisher rests against the shim 13. Where larger diameter cylindrical tanks eliminate the need for shim 13, the shim may be either retained on support 26 by tabs 15 or may be detached from the support 26 and discarded.

As seen in FIG. 1, a pair of cross ribs 24 and 25 extend transverse to the longitudinal axis of the bracket 14. The front face of the cross ribs define a curvature which accommodates larger diameter tanks for which the bracket is adapted. Between the cross ribs 24, 25 and to either side of body 14, a pair of walls 37 and 38 define a pair of slots B, C to either side of the body 14.

Each of the straps 11 and 12 comprise a generally flat rectangular shaped element. At one end, each strap 11 and 12 has a shoulder 39 (see FIG. 5) which protrudes outwardly from the end of the strap. This end of each of the straps 11, 12 is inserted within one of the slots B, C located at either side of the body 14. The thickness and width of this end of the straps is slightly less than the dimensions of slots B and C so that the end of the strap may be inserted at an angle through the desired slot.

Figure 5:
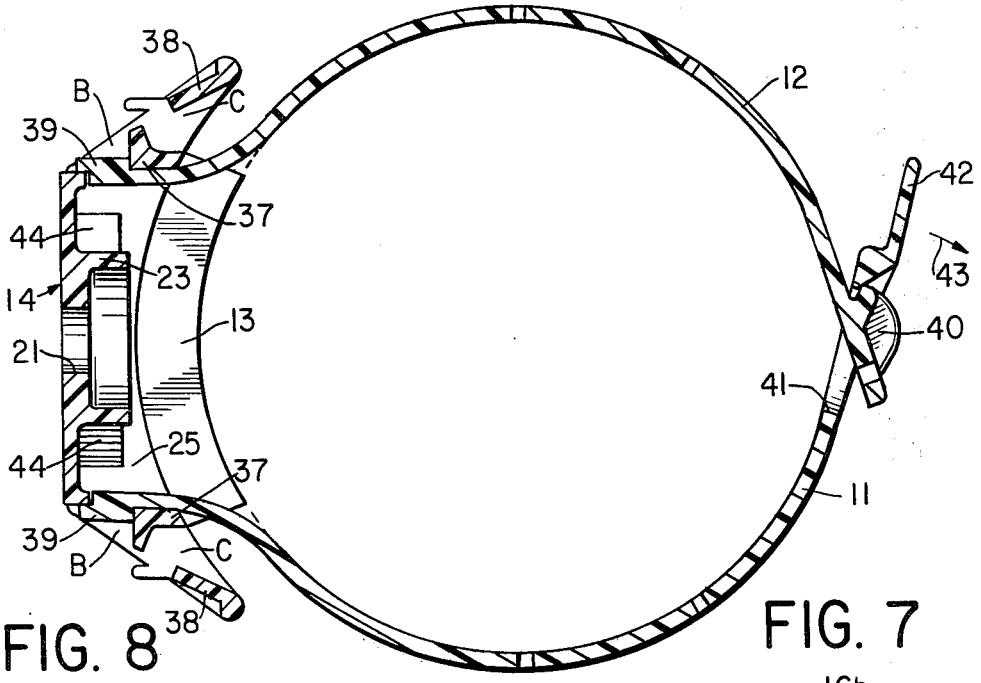
FIG. 5 is a cross-sectional plan view taken along the line 5—5 of FIG. 3.

After insertion into the desired slot, the end of the strap having shoulder 39 is arranged generally perpendicular to the rear face of body 14 so that the protruding portion of shoulder 39 abuts against a portion of the body 14 to support the straps 11 and 12 on body 14 (see FIG. 5). The straps are easily removed from the slots B, C by collapsing the straps inwardly to form an acute angle between the strap and the rear face of body 14. Since the protruding end of shoulder 39 will no longer abut against a portion of body 14, each strap may be easily removed by displacing the strap along its longitudinal axis out from the slot B, C. The straps are thus easily adapted to cylinders 34 of different diameters by utilization of an appropriate combination of slots. The smallest diameter cylinders are accommodated by engaging the straps in slots B, B, intermediate diameter cylinders by use of a combination of slots B and C, and the largest diameter cylinders by use of slots C, C.

Although the body 14 is illustrated as having two slots B and C at either side of the body, it will be apparent that additional slots may be provided so that tanks encompassing an even greater range of diameters can be accommodated.

The opposite end of the straps 11 and 12 are provided with means for detachably engaging the straps around the tank 34. As best seen in FIG. 1, one strap is provided with a barb 40 and the other strap with an aperture 41 capable of detachably receiving the barb 40. The straps are engaged over the tank 34 by inserting the barbed end of the strap into the aperture 41 so that the barb 40 catches onto a portion of the opposite strap. The extinguisher is easily and quickly removed from the engaged straps by urging the handle 42 (see FIG. 5) of the apertured strap outwardly in the direction of arrow 43. This will quickly release the barbed end and provide access to the fire extinguisher 31. It should be apparent that ready access to the fire extinguisher may be of great importance in emergency and possibly stressful situations.

In one embodiment, a stop 19 is provided at the front end of each prong 18 to engage portions of the valve-gauge unit 32 of the fire extinguisher 31. The stops 19 limit possible rotation of the fire extinguisher 31 so that the face of gauge 33 of fire extinguisher 31 faces outwardly from the bracket, presenting the gauge for easy readability. As seen in FIG. 4, the gauge 33 can rotate only through a limited angle defined by the gap between the stops 19 and the stem portion 35 of gauge 33. Further rotation of the gauge is prevented since a portion of the gauge will abut against the stops 19. Thus, the fire extinguisher is kept aligned with the gauge facing outwardly, away from the surface on which bracket unit 10 is mounted.

In a preferred embodiment, the bracket unit 10 is of medium-impact polypropylene. This material, as well as other suitable plastics, advantageously provides durability and impact resistance and at the same time allows economical utilization of conventional molding techniques such as injection molding. However, it should be apparent that a variety of alternative materials and techniques may be utilized in the construction of the bracket unit.

It will be evident to those having ordinary skill in the art that the present invention may take a variety of forms, that the foregoing description is merely illustrative, and that the scope of protection afforded this invention is to be determined by the appended claims.

What is claimed is:

1. A unit for holding a fire extinguisher having a neck portion and a valve gauge, said unit being adjustable for fire extinguishers of various diameters and comprising:

a bracket body having transversely extending curved ribs against which a portion of the fire extinguisher can rest, and a plurality of walls extending between the ribs to define two apertures located on opposite sides of the bracket body;

clamping means located on an upper portion of the bracket body for receiving the neck portion of the fire extinguisher and having a pair of prongs and a stop on each prong, each stop being engagable with a corresponding portion of the valve gauge so that rotation of the fire extinguisher is limited and the valve gauge faces away from the bracket body;

a pair of straps detachably affixed to the bracket, each of said straps having at one end means for releasably engaging the bracket body in one of said apertures, one of said straps having an aperture at the other end thereof, and the other of said straps having a barb which is releasably engagable with the aperture in said strap, thereby enabling the pair of straps to act together releasably to secure the fire extinguisher to the bracket body;

a support member formed on a lower portion of the bracket body to engage the fire extinguisher and having a face bearing a set of spaced apart ribs; and a shim detachably affixed to the bracket body and having a face bearing a corresponding set of spaced apart ribs, the ribs on said shim and said support member being adapted to mesh together only upon insertion of the shim between the fire extinguisher and the support member to support fire extinguishers of selected diameters.

2. The unit defined by claim 1, wherein the pair of straps and the shim are frangibly affixed to the bracket body.

3. The unit defined by claim 2, wherein the pair of straps is frangibly affixed to the bracket body by tab means.

4. The unit defined by claim 2, wherein the shim is frangibly affixed to the support member.

5. The unit defined by claim 4, wherein the shim is frangibly affixed to the support member by tab means.

6. The unit defined by claim 1, wherein each of the pair of straps is elongated along an axis and each of the pair of straps is parallel to the bracket body prior to detachment therefrom.

7. The unit defined by claim 1, wherein said means for releasably engaging the bracket body comprises a shoulder protruding from said one end of each of said straps.

* * * * *